US006857631B2

(12) United States Patent
Morrison et al.

(10) Patent No.: US 6,857,631 B2
(45) Date of Patent: Feb. 22, 2005

(54) PRINTER SHEET FEEDING PATH IDLER ROLLERS BIASED MOUNTING SYSTEM

(75) Inventors: Elden R. Morrison, Rochester, NY (US); Wayne C. Powley, Ontario, NY (US); Dara N. Lubin, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/620,069

(22) Filed: Jul. 15, 2003

(65) Prior Publication Data

US 2005/0012264 A1 Jan. 20, 2005

(51) Int. Cl.[7] ..... B65H 5/02
(52) U.S. Cl. ..... 271/274; 267/155
(58) Field of Search ..... 271/274; 198/624; 267/154, 155

(56) References Cited

U.S. PATENT DOCUMENTS 4,850,584 A * 7/1989 Watashi ..... 271/274
5,265,869 A * 11/1993 Morita ..... 271/274
5,600,426 A * 2/1997 Gramlich et al. ..... 399/381
5,926,935 A * 7/1999 Mizuta et al. ..... 29/446
6,173,952 B1 1/2001 Richards et al.
6,336,629 B1 * 1/2002 Carter et al. ..... 271/274
6,619,658 B2 * 9/2003 Shiau ..... 271/274

* cited by examiner

*Primary Examiner*—David H. Bollinger

(57) ABSTRACT

A sheet feeding system in which the idler roller shafts are loosely mounted between opposing side walls of a slot for limited movement relative to their mating sheet feeding rollers, and spring biased theretowards to provide sheet feeding nips with the desired normal force, wherein the spring biasing is nonsymmetrical to additionally provide an orthogonal spring biasing of the idler shafts towards only one of the side walls of their mounting slots. This nonsymmetrical spring biasing may be provided by a torsion spring with a central coil wrapped around the idler shaft and extending legs anchored in nonsymmetrical anchoring positions and/or with nonsymmetrically shaped legs.

2 Claims, 3 Drawing Sheets

PRINTER SHEET FEEDING PATH IDLER ROLLERS BIASED MOUNTING SYSTEM

Figure 1:
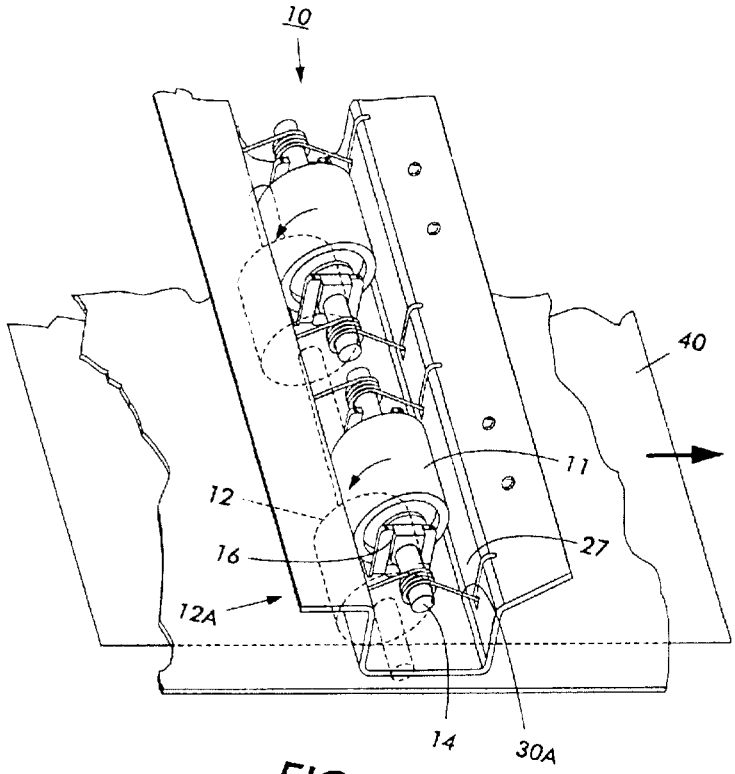

Disclosed in the embodiments herein is a simple and very low cost but effective improvement in the spring loaded mounting system of the idler rollers of the print media transport roller drive nips which are spaced along the sheet transport path of a printer, to reduce print media sheet transport misregistration and/or noise.

By way of background, the typical paper path of a printing apparatus includes a substantial number of idler rollers mating with drive rollers to form print media sheet transporting nips at regular intervals along the paper path. Those intervals generally corresponding to the smallest size sheet to be fed through the printing apparatus. While the idlers do not drive the sheet directly, they are important in providing the nip normal force to ensure non-slip feeding, and to help ensure that the print media travels straight down the sheet path without skewing or translating laterally. Particularly in a long printer path, the accumulated media transport misalignment errors from multiple sequential media transport nip sets can require expensive sheet re-registration and/or deskew stations in the paper path, which can add considerable costs and complexity.

Yet, it is normally necessary that the idlers be freely rotatable and correctly aligned with the paper path, and also slightly vertically moveable to accommodate different thicknesses of the paper or other print media and variable deformations of the elastomeric materials of the drive rollers and/or idlers, plus wear and aging differences in operative diameters.

This providing of limited vertical movement of the supporting shafts of the idler rollers, and the requirement for substantial quantities of such idler mountings, renders significant the ability to do so at low cost and with simple manufacturing. Known systems of allowing the idler shaft to vertically "float" within a vertical slot formed by guides while being spring loaded down towards the drive rollers, as in the exemplary prior art of FIG. 2, have been found by the inventors to have some inherent problems, which the present embodiments can overcome.

The need to ensure the vertical movement of the idler shaft within its vertical slot, plus requisite manufacturing tolerances, causes idler shafts to be of a smaller diameter than the width of the vertical slot in which they ride and vertically move. Thus, during operation, it is possible for one such supported end of the idler shaft to move differently than the other end of that idler supporting shaft in another such guide or slot, thereby imparting a slight angle to the idler(s) on that shaft relative to the desired state, which can lead to the above-mentioned and other problems. In addition, upon the start-up of the drive rollers, unnecessary noise may be generated by the driving engagement of the drive rollers forcing or slapping the idler shafts to one side wall of their vertical mounting slot or the other.

Of particular interprets by way of background and supplemental disclosure herein is Xerox Corp. U.S. Pat. No. 6,336,629 issued Jan. 8, 2002 to the same Wayne C. Powley and Daniel L. Carter and Alan G. Schlageter, entitled "Idler Mounting Tie-Bar Assembly."

One example of a printer with a long paper path with multiple drive rollers and mating idlers is the Xerox Corp. "iGen3"™ printer. See, for example, Xerox Corp. U.S. Pat. No. 6,173,952 B1 issued Jan. 16, 2001 to Paul N. Richards, et al, which may be incorporated by reference. Note especially FIG. 8 thereof, inter alia.

Disclosed herein is a simple and very low cost change in the idler mounting system for such media transport paths which improves the functional performance of driving the sheets straight through the paper path. A simple change in the spring biasing arrangement for the idler shaft continues to provide the proper normal force to the idlers to nip the print media between the drive roller and the idler for slip-free drive, yet now additionally biases the idlers in a desired direction against only one side of the idler shaft mounting slot, to greatly expand acceptable slot and shaft dimensional tolerances in the system, yet keeping the idlers square with the drive rollers for improved media tracking.

A specific feature of the specific embodiments disclosed herein is to provide a sheet feeding system in which sheets are fed in a process direction in a sheet feeding path by plural spaced apart sheet feeding nips formed by driven sheet feeding rollers and mating idler rollers, wherein said idler rollers are mounted for rotation on idler shafts and said idler shafts are mounted within mounting slots having two opposing side walls, and wherein said idler shafts have limited movement within said mounting slots relative to said driven sheet feeding rollers, and wherein said idler shafts are spring biased by a normal force spring biasing system towards said driven sheet feeding rollers to engage said idler rollers with said driven sheet feeding rollers to provide said sheet feeding nips with a desired normal force; wherein said normal force spring biasing system is nonsymmetrical to additionally provide an orthogonal spring biasing of said idler shafts towards only one of said two opposing side walls of said mounting slots in which said idler shafts are mounted.

Further specific features disclosed in the embodiments herein, individually or in combination, include those wherein said nonsymmetrical spring biasing system is a nonsymmetrical torsion spring; and/or in which said nonsymmetrical spring biasing system is a torsion spring with a central coil wrapped around said idler shaft and extending nonsymmetrical legs; and/or in which said nonsymmetrical spring biasing system is a torsion spring with a central coil wrapped around said idler shaft and extending legs anchored in nonsymmetrical anchoring positions; and/or in which said sheet feeding path of plural spaced apart sheet feeding nips of driven sheet feeding rollers and mating idler rollers is the sheet feeding path of a printer; and/or a sheet feeding method in which sheets are fed in a process direction in a sheet feeding path by plural spaced apart sheet feeding nips formed by driven sheet feeding rollers and mating idler rollers, wherein said idler rollers are rotatable on idler shafts and said idler shafts are mounted within mounting slots having two opposing side walls, and wherein said idler shafts have limited movement within said mounting slots relative to said driven sheet feeding rollers, and wherein said idler shafts are spring biased by a normal force spring biasing towards said driven sheet feeding rollers to engage said idler rollers with said driven sheet feeding rollers to provide said sheet feeding nips with a desired normal force; wherein said normal force spring biasing is nonsymmetrical to additionally provide an orthogonal spring biasing force of said idler shafts towards only one of said two opposing side walls of said mounting slots in which said idler shafts are mounted; and/or in which said nonsymmetrical spring biasing is provided by a nonsymmetrical torsion spring; and/or in which said nonsymmetrical spring biasing is provided by a torsion spring with a central coil wrapped around said idler shaft and extending nonsymmetrical legs; and/or in which said nonsymmetrical spring biasing is provided a single nonsymmetrical torsion spring with a central coil wrapped around said idler shaft and extending legs anchored in nonsymmetrical anchoring positions.

The term "reproduction apparatus," "printing apparatus," or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical print media substrate for images.

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular components or mountings illustrated herein are merely exemplary, and that the same novel functions can be provided by modifications of other known or readily available alternatives. What is well known to those skilled in the art need not be re-described herein.

Figure 2:
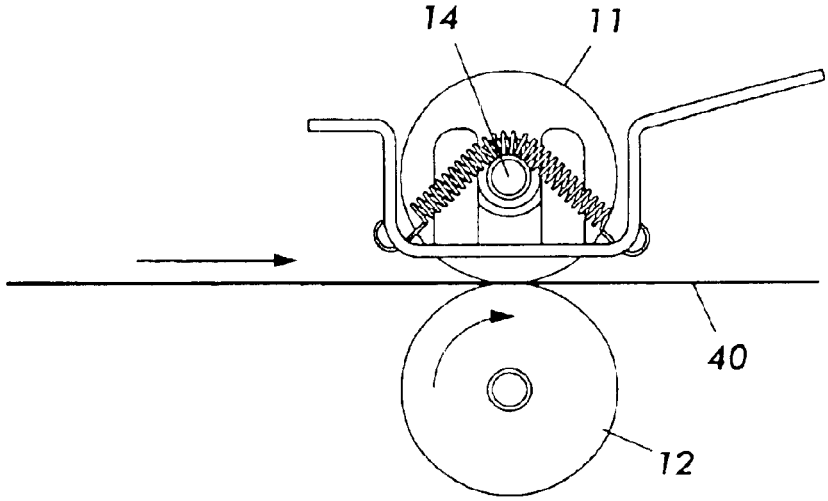
FIG. 2 PRIOR ART
Figure 3:
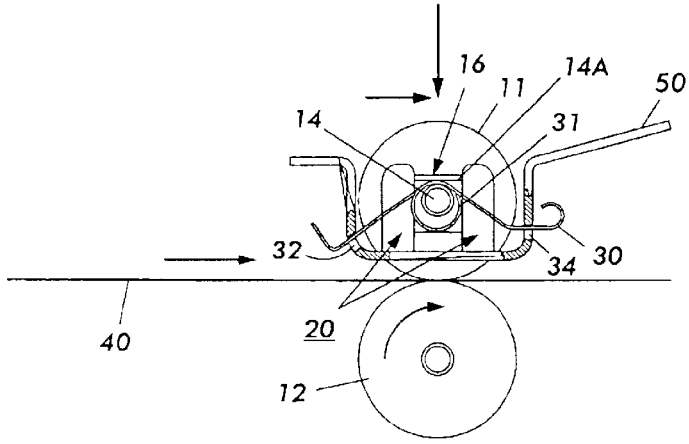
Figure 4:
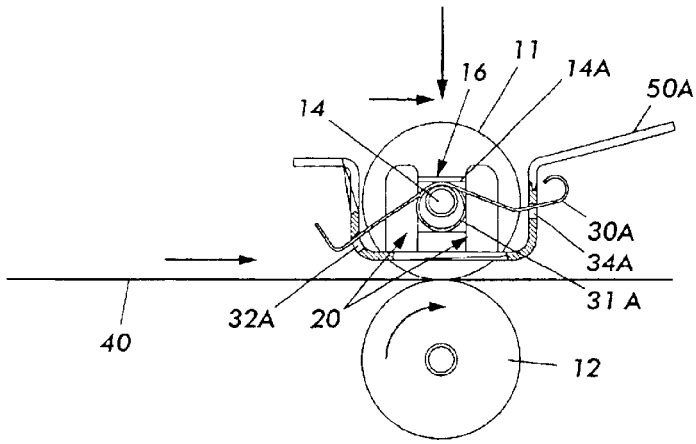

Various of the above-mentioned and further features and advantages will be apparent to those skilled in the art from the specific apparatus and its operation described in the examples below, and the claims. Thus, the present invention will be better understood from this description of these specific embodiments, including the drawing figures (which are approximately to scale) wherein:

FIG. 1 is a partial upper perspective view of a portion of an exemplary printer paper path showing one example of the subject idler rolls mounting and spring loading system;

FIG. 2, labeled "Prior Art," is a partial side view of a typical prior art idler roll mounting system design including a garter spring applying only a vertical normal force component to the idler shaft, thus leaving that shaft free to "wobble" between the two vertical walls of its vertical mounting slots;

FIG. 3 is a side view of one exemplary embodiment of the subject improved idler rolls mounting system in which the idler shaft is biased laterally (forwardly) against only one side wall of its mounting slot, as well as downwardly for normal force, by the same novel spring arrangement; and FIG. 4 is a second, alternative, embodiment of the subject exemplary improved system of FIG. 3 with a different novel spring arrangement.

Describing now in further detail the exemplary embodiments with particular reference to FIGS. 3 and 4, all of the relevant portions of a printer paper path are illustrated. The rest may be conventional, and is well known to those skilled in the art. In all of the Figs. there is illustrated the same basic sheet feeding system 10 with idler rollers 11 mating with driven rollers 12 to form sheet feeding nips, in nip sets extending along the printer paper path. The idler rollers 11 are freely rotatably mounted on idler shafts 14 (which may have attached idler shaft guides 14A) of a diameter or width slightly less than the. width of the slot 16 in which the idler shaft 14 and its guide 14A (if any) are vertically moveable within the respective opposing confining walls defining the slot 16, formed here by the inside vertical parallel walls of upstanding tangs 20. The idler shaft 14 is centrally biased downwardly toward the drive rollers 12 by a torsion spring 30 or 30A (which, as will be seen, varies somewhat in its shape and end mountings between the embodiments of FIGS. 3 and 4, and also differs from the additional conventional purely normal force springs 27 shown in FIG. 1). The feeding direction of the sheets 40 being fed through the nips is shown by their movement direction arrow and the rotational arrows of the rollers.

Referring to FIGS. 3 and 4, the ends of the torsion springs 30 or 30A may be restrained in simple slots, guides or tangs 32, 34, or 32A, 34A, in the frame or baffle plate 50 or 50A of the paper path. Note that the center coil 31 or 31A of the torsion spring 30 or 30A is wrapped loosely around (slid onto) the idler shaft 14. But as end mounted, the spring 30 or 30A is under tension and provides the desired normal force downwardly on the shaft 14 to bias the idler rollers 11 against the drive rollers 12.

However, it may be seen that the end mounting positions 32, 34, or 32A, 34A, of the springs 30 or 30A, on the opposite sides of the center coil 31 or 31A, may be at different vertical distances, especially as shown in FIG. 4, where the spring mounting point 32A is considerably lower that the other spring end mounting point 34A. The spring 30 of FIG. 3 is bent on one side or leg so as to engage one mounting point 34 at a different angle than the other mounting point 32. (That can also be true of spring 30A of FIG. 4.) That is, the two spring 30 legs are not symmetrical as in prior art spring mountings such as that of FIG. 2. Here, the unsymmetrically formed (and/or differently opposite end mounted) springs 30 or 30A perform a second important function by also providing an additional lateral force substantially perpendicularly to the primary normal force. The springs 30 or 30A also bias the idler shaft 14 laterally against only one wall of the vertical mounting slot 16, that is, against only one of the two facing tangs 20 inner faces, such as the downstream face.

The previous unconstrained movements in the lateral or horizontal direction of the idler shaft 14 between the two sides of the slot 16 are thus removed by altering the shape of one of the legs of the torsion spring and/or changing the end anchor points of the spring to different positions.

Thus, a lateral positioning spring force is provided which is smaller than the vertical normal force but sufficient to hold the idler shaft 14 or its guide 14A against only one side wall of the slots 16, but still allowing vertical floating movement of the idler shaft. This reduces the effect of manufacturing tolerances and resultant sheet misalignment caused by idler misalignments. This lateral spring force, which is preferably in the downstream process sheet feeding direction of movement of the sheets 40, ensures that the idler shafts all remain biased against the inside surfaces of only the downstream tangs 20, which can be set as the datum plane in the manufacturing and setup of the printing apparatus. Superior alignment of the idlers with the drive rollers is thus provided, which results in superior media tracking.

Another option would be to use a regular normal force spring in addition to (paired with) an example of the subject lateral plus normal force spring.

It will be noted that the FIG. 1 illustrated "U" shaped bracket in which the idlers and their springs are mounted may be essentially the same as that of the above-cited U.S. Pat. No. 6,336,629, modified with "J" shaped wall apertures or other suitable spring end mounting points 34, and need not be re-described herein. However, the present system and its advantage is not limited to any such particular mounting system.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A sheet feeding system in which sheets are fed in a process direction in a sheet feeding path by plural spaced apart sheet feeding nips formed by driven sheet feeding rollers and mating idler rollers, wherein said idler rollers are mounted for rotation on idler shafts and said idler shafts are mounted within mounting slots having two opposing side walls, and wherein said idler shafts have limited movement within said mounting slots relative to said driven sheet feeding rollers, and wherein said idler shafts are spring biased by a normal force spring biasing system towards said driven sheet feeding rollers to engage said idler rollers with said driven sheet feeding rollers to provide said sheet feeding nips with a desired normal force; wherein said normal force spring biasing system provides a nonsymmetrical spring biasing of said idler shafts towards only one of said two opposing side walls of said mounting slots in which said idler shafts are mounted, wherein said nonsymmetrical spring biasing is provided by a nonsymmetrical torsion spring with a central coil wrapped around said idler shaft and integral extending uncoiled generally linear wire legs anchored adjacent their outer ends in nonsymmetrical anchoring positions.

2. The sheet feeding system of claim 1 in which said sheet feeding path of plural spaced apart sheet feeding nips of driven sheet feeding rollers and mating idler rollers is the sheet feeding path of a printer.

* * * * *